United States Patent [19]

Schips

[11] Patent Number: 4,593,636

[45] Date of Patent: Jun. 10, 1986

[54] SEWING MACHINE WITH APPARATUS FOR SEWING A CURVED SEAM

[76] Inventor: Helmut Schips, Steinacherstrasse 340, CH-9327 Tübach, Switzerland

[21] Appl. No.: 746,722

[22] Filed: Jun. 20, 1985

[30] Foreign Application Priority Data

Jun. 23, 1984 [DE] Fed. Rep. of Germany ..... 3423239

[51] Int. Cl.[4] ..... D05B 21/00; D05B 35/10

[52] U.S. Cl. ..... 112/308; 112/121.12; 112/121.24

[58] Field of Search ..... 112/121.11, 121.12, 112/308, 309, 121.24, 262.3, 153

[56] References Cited

U.S. PATENT DOCUMENTS 3,072,081 1/1963 Milligan et al. ..... 112/308 X 3,263,634 8/1966 Gross ..... 112/153

4,178,862 12/1979 Bianchi et al. ..... 112/121.11

4,188,893 2/1980 Shimazaki ..... 112/121.11

*Primary Examiner*—Werner H. Schroeder

*Assistant Examiner*—Andrew M. Falik

*Attorney, Agent, or Firm*—Wigman & Cohen

[57] ABSTRACT

A sewing machine has a first transporting device for transporting the material to be sewn while a straight seam is being sewn and a second transporting device for transporting the material to be sewn while a curved seam is to be sewn. The second transporting device is mounted on a rotatable axis and is capable of rotating the material to be sewn. A control device having a sensor scans the seam to be sewn and changes the mode of the sewing machine from the first transporting device to the second transporting device when appropriate.

18 Claims, 2 Drawing Figures

SEWING MACHINE WITH APPARATUS FOR SEWING A CURVED SEAM

BACKGROUND OF THE INVENTION

The invention relates to a sewing machine having a transport device for the material to be sewn, which transport device includes a transporter which engages on one side of the material to be sewn and a presser foot which can be placed on the other side of the material to be sewn in the effective area of the transporter.

Although in the known sewing machines of this type the transporter performs a straight transport movement, not only straight seams but also so-called inside curves, i.e., seams that curve in a concave manner when viewed from the edge of the material to be sewn, can be performed at high speed with the use of an edge guide. In contrast, to sew an outside curve, i.e. a seam along a path curved in a convex manner as viewed from the edge of the material to be sewn, the operator must manually guide the material to be sewn, which, independent of the ability of the operator, requires to a greater or lesser degree, a reduction in the sewing speed in order to be able to produce the seam with the necessary precision. Above all, with sewing material in which the outside curve comprises a substantial proportion of the overall sewing length, such as is the case, for example, with pocket pouches for pockets in clothing items, the reduction in operating speed during sewing of the outside curve does not permit full usage of the capacity of the sewing machine.

SUMMARY AND OBJECTS OF THE INVENTION

The object of the invention, therefore, is to create a sewing machine which makes it possible to produce even outside curves at the full sewing speed, i.e., to fully utilize the operating capacity of the sewing machine.

Briefly described, the object is accomplished according to the invention by providing, in an industrial sewing machine, in addition to a first transporter means for material to be sewn, a second transporter means for material to be sewn having a transport element rotatable about an axis parallel to and at a distance from the longitudinal axis of the needle of the sewing machine. Control means are provided for placing each of the transporter means in either an effective or an ineffective condition. When it is desired to sew a straight seam the first transporter means is placed in effective condition and the second transporter means is placed in ineffective condition. When an outside seam is desired the second transport device takes over the feed of the material to be sewn and retains this function until the end of the outside curve. Thus it is assured that this type of outside curve can be sewn at the full sewing speed. The control device hereby causes the first transport device to become ineffective during the transport of the material to be sewn by the second transport device and causes both transport devices to be switched from the ineffective into the effective condition at the correct time.

The point in time for the switching of the transport devices can be determined in various ways. For example, by a suitable design of the control device, the stitch count can be set after which the one transport device yields the transport of the material to be sewn to the other transport device. In another advantageous embodiment the control device has a sensor which scans an edge of the material to be sewn parallel to the seam to be produced, at a point in front of the operating point of the sewing needle. When it recognizes the beginning and the end of an outside curve it produces control signals, which, when received by control device, control the two transport devices. In order not to have to locate the sensor extremely close to the operating point of the sewing needle, the control device has preferably a delay device which delays the switching of the transport devices from the point in time of recognition of the beginning or end of the outside curve to a degree necessary, for example, for an adjustable length of seam or an adjustable number of stitches. In a preferred embodiment the sensor is formed by a light barrier, because it is not susceptible to damage and particularly, is well suited for any type of material to be sewn.

The second transport device preferably includes a separate drive motor in order to be able to design the drive in the simplest possible manner, and, above all, to be able to build the second drive onto a sewing machine in a simple manner without having to alter the design thereof, which also simplifies a later addition thereof. If, as is generally the case, one must produce not only an outside curve, but rather the outside curve represents only a portion of the seam, it is generally desirable to have the same stitch length in the portion forming the outside curve as in the other portions, where the material to be sewn is transported by the first transport device. In a preferred embodiment, therefore, the rotational movement of the drive motor of the second transport device is controlled by the control device in dependence on the operating speed of the sewing machine. This can be achieved in a simple manner with the use of a step motor controlled with an impulse frequency that is proportional to the rotational speed of the main drive of the sewing machine.

BRIEF DESCRIPTION OF THE DRAWINGS

The invention is described in greater detail below with the aid of an exemplary embodiment illustrated in the drawings.

DETAILED DESCRIPTION OF A PREFERRED EMBODIMENT

Figure 1:
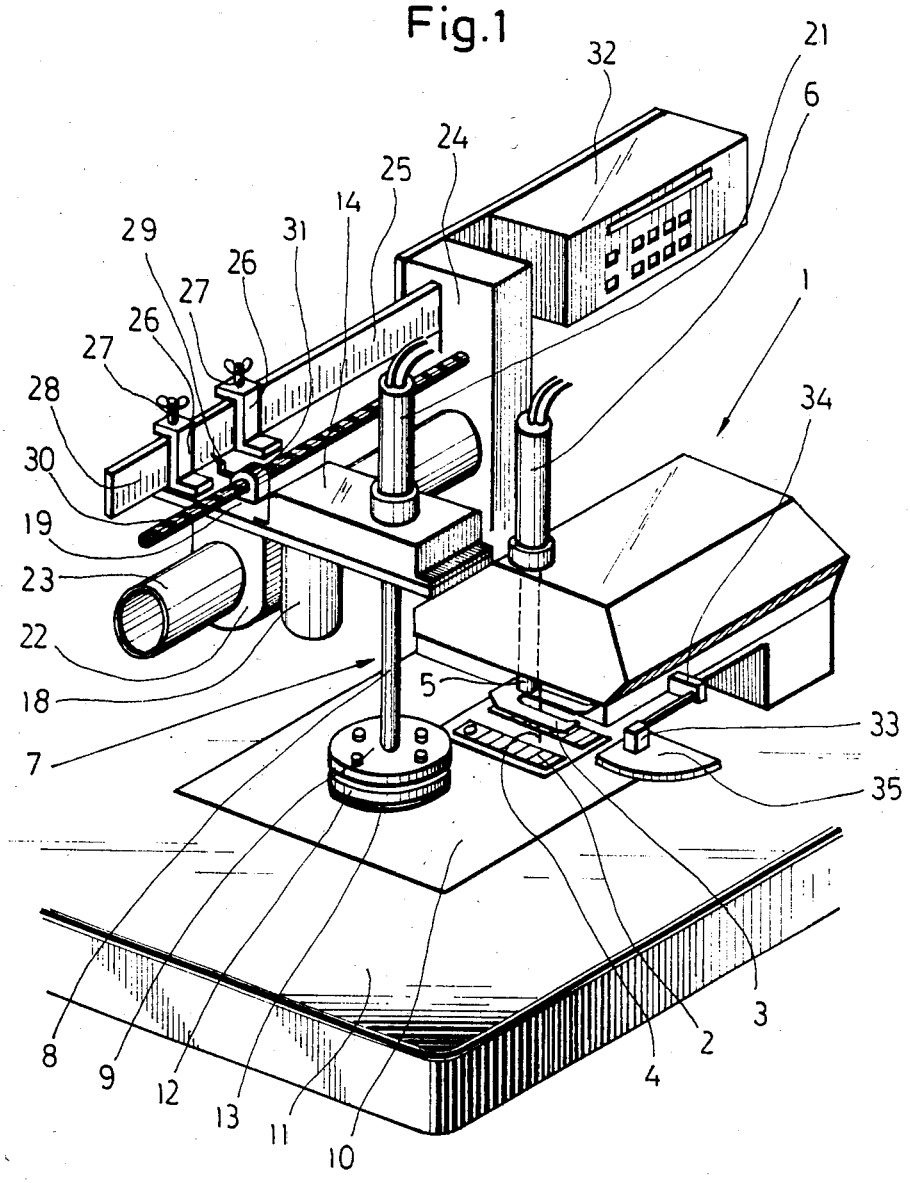
FIG. 1 is a perspective view of the exemplary embodiment.

An industrial sewing machine with a head 1 formed in a known manner includes a first transport device which consists of a transporter 2 and a presser foot 3. The transporter 2 is formed and arranged in a known manner, i.e., it presses against the underside of the material to be sewn in the stitching area of the sewing needle 4 and moves said material in a straight line, while the presser foot 3 presses the material to be sewn from above against the transporter 2. The presser foot 3 is attached to the lower end of a vertical shiftable activating bar, the upper end of which is coupled with a pneumatic operating cylinder 6, which, in the exemplary embodiment is placed on the head 1. The first transport device is only effective when the presser foot 3 is lowered.

As shown particularly in FIG. 1, the sewing machine has, in addition to the first transport device, a second transport device designated generally with the numeral 7. This second transport device 7 has a drive shaft 8 arranged parallel to the longitudinal direction of the sewing needle 4, which drive shaft 8 is movable in its longitudinal direction and is arranged at a distance from the sewing needle at the side adjacent the head 1. A support and carrier disc 9 is connected to the lower end of the drive shaft 8, which disc 9 lies in a plane that is parallel to the support surface for the material to be sewn and lies above this support surface. The support surface for the material to be sewn is formed by a smooth plate 10 beneath the support and carrier disc 9, on which plate 10 the material to be sewn can be moved with practically no friction. This plate 10 is placed in the support table 11 of the sewing machine in such a manner that its upper side lies flush with the remaining portion of the support surface for the material to be sewn. A pressure disc 12 is yieldingly supported in its axial direction on the underside of the support and carrier disc 9 with springs interposed therebetween. The pressure disc 12 is connected with the support and carrier disc 9 so as to rotate therewith and be radially fixed in its position. This insures that the displacement path does not have to be adapted to the thickness of the material sewn. On its underside facing the plate 10, the pressure disc 12 is provided with a rubber layer 13, so that the material to be sewn may be carried without slippage when the stamp formed by the support and carrier disc 9 and the pressure disc 12 is lowered to apply pressure on the upper side of the material to be sewn. It would also be possible to clamp the material to be sewn between the transport element and a rotatable disc arranged on the same axis as the transport plate. In most cases, however, it will suffice to lay the material to be sewn on smooth plate 10 on which can be moved with only insignificant friction, and to press the transport element 7 against the side of the material to be sewn lying opposite to this plate. The use of a plate instead of a rotatable disc as a counter support for the transport element has the advantage that only the second transport device needs to be adjusted to adjust the second transport device to different sizes of radius of the outside curve.

Figure 2:
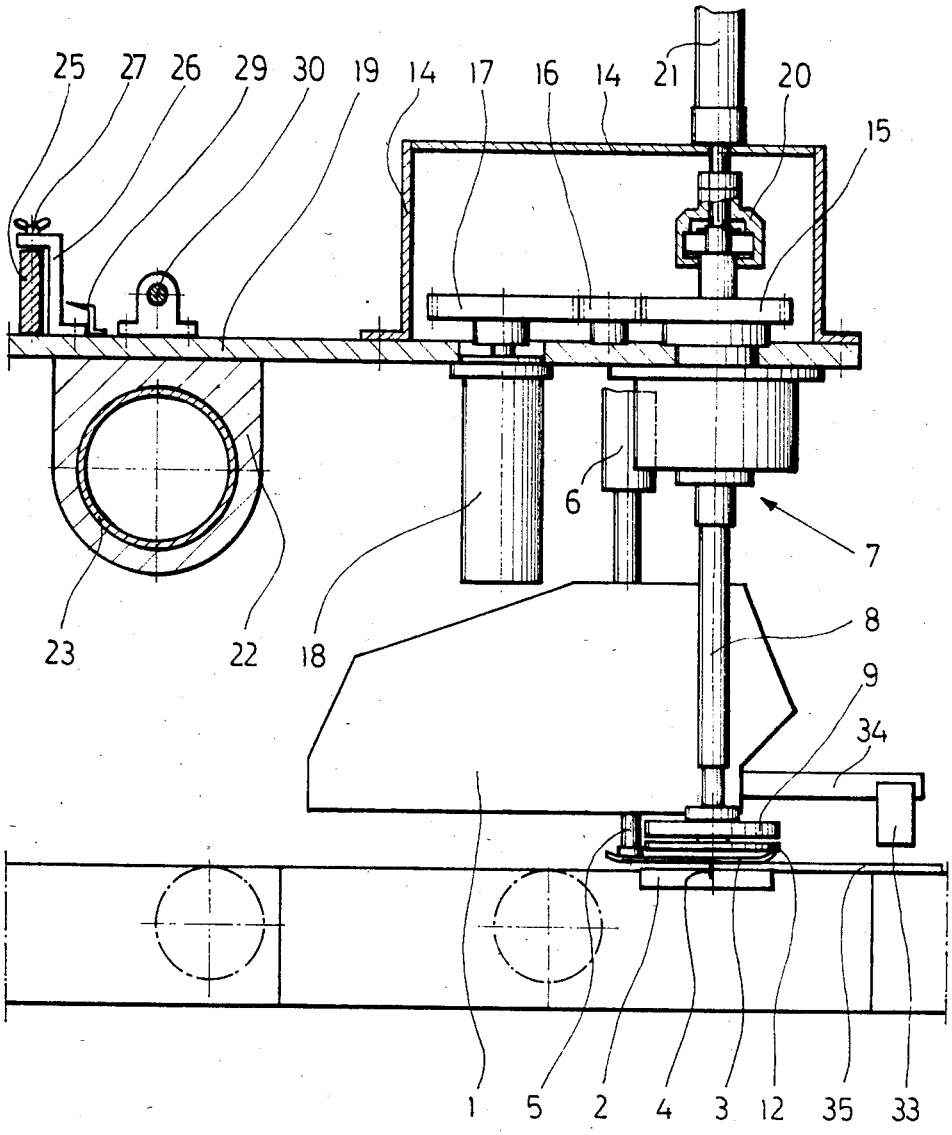
FIG. 2 is a side view of the exemplary embodiment illustrated partially in cross-section.

The drive shaft 8 is connected with a gear 15 rotatably mounted in a housing 14 so as to rotate therewith and yet be axially shiftable. The gear 15 is connected in the exemplary embodiment with a drive pinion 17 by means of an intermediate gear 16. The drive pinion 17 is seated on the shaft of a step motor 18 so as to rotate with the shaft. As shown in FIG. 2, the step motor 18 is flanged to the underside of the housing 14 formed by a base plate 19 that extends backwards beyond the upper portion of the housing 14.

Within the housing 14, as shown in FIG. 2, the upper end of the drive shaft 8 is coupled with a pneumatic operating cylinder 21 by means of a coupling element 20, which cylinder 21 is arranged coaxially to the drive shaft 8, so as to be rotatable therein and yet be immovable in its axial direction. The operating cylinder 21 is flanged to the upper side of the housing 14. Drive shaft 8 is thus coupled with a shifting device formed by pneumatic cylinder 21 for longitudinal shifting of drive shaft 8 supporting second transport device 7 during activation and deactivation.

A hub 22 is fixed to the underside of the portion of the base plate 19 projecting beyond the housing 14, which hub 22 is penetrated by a horizontal tube 23, extending laterally to the direction of transport of the first transport device, whereby only a sufficient amount of play is provided between the tube 23 and the bore in the hub 22 to assure the necessary movability. At its end illustrated on the right in FIG. 1, the tube 23 is rigidly connected with a vertical support 24, which is arranged behind the head 1 at a point that does not hinder the transport of the material to be sewn. The base plate 19 is held in its horizontal position by a rail 25, which is arranged parallel to the tube 23 but is offset relative thereto in the horizontal direction in such a manner that the upper side of the base plate 19 contacts the underside of the rail 25. Like the tube 23, the rail 25 is connected at its end illustrated at the right side in FIG. 1 to the vertical support 24. Two mounting brackets 26 attached to the base plate 19 and spaced from each other in the longitudinal direction of the rail 25 overlap the rail 25. The shanks of these mounting brackets 26 which overlap the rail 25 each carry a wing nut 27 as a clamping device. If these wing nuts 27 are tightened, then the rail 25 is fixed in its position. The base plate 19 is held by this means in its horizontal position and is secured against a shifting in the longitudinal direction of the tube 23 and the rail 25.

As shown in FIG. 1, the rail 25 is provided with a scale 28 running in its longitudinal direction, which scale 28 cooperates with an indicator 29 fixed to the base plate 19. The scale 28 is provided with numbers in such a manner that they, together with the indicator 29, give the adjusted radius given the seam when the material to be sewn is transported by the second transport device 7. There is thus provided a mount that permits lateral adjustment of the second transport 7 with respect to the first transport device in order that different sizes of radii of seam may be produced.

In the exemplary embodiment, a rotatable threaded spindle 30 is provided and is arranged parallel to the tube 23. In order to adjust the second transport device 7 in the longitudinal direction of the tube 23 rotatable threaded spindle 30 engages a spindle nut 31 fixed to the base plate 19 and therefore moves the base plate 19 when threaded spindle 30 is rotated. The rotation of the threaded spindle 30 takes place in the exemplary embodiment by means of a manually activated crank (not shown). It could also take place, however, by means of an electric motor.

A control device 32, with the exception of a light barrier 33, is attached to a lateral arm of the vertical support 24. Control device 32 is an electronic device having an input for loading data, inputs for signals from a digital rotational speed indicator and from a light barrier 33, memories, a microprocessor, and an output. This light barrier 33 has the purpose of scanning the edge of the material to be sewn that is guided to the sewing needle 4, in order to recognize the beginning and the end of an outside curve and thereby produce an appropriate control signal. The light barrier 33 is therefore arranged above a straight line, along which a straight edge of a piece of material to be sewn would run. It is spaced in front of the stitching area of the sewing needle 4, and is attached to a mount 34 which is attached at its other side to the head 1 in the exemplary embodiment, as shown in the drawings.

Based on the signal of the light barrier 33 indicating the beginning of an outside curve, the control device, with the aid of a delay device having a time delay dependent on the distance of the light barrier 33 from the sewing needle 4, produces a control signal, which has the result that the pneumatic operating cylinder 21 lowers the drive shaft 8 and presses the rubber layer 13 of the pressure disc 12 against the material to be sewn. The time delay is a counter for the number of stitches, which number is dependent on the number of revolutions of the drive shaft and on the length of each stitch. The time delay counter is started by the first signal of the light barrier 33. If a predetermined number of stitches corresponding to the distance from the detecting point of the light barrier 33 to the needle 4 is counted, the microprocessor or a comparator of control means 32 initiates a signal to actuate the second transport device 7 and to deactuate the first transport device. In addition the counter is set to zero. Subsequently, the control device, based on a signal of the light barrier 33 indicating the end of an outside curve, produces a control command which restarts the counter, and after having counted the predetermined number of stitches, results in a raising of the pressure disc 12 by means of the pneumatic operating cylinder 6 away from the material to be sewn and a lowering of the presser foot 3 with the required time delay. Both pneumatic cylinders 6 and 21 are provided with a solenoid-operated valve (not shown), which valves are controlled by electrical signals from the control means 32. A pneumatic cylinder controlled by a solenoid-operating valve is known for actuating the verically shiftable activating bar of an industrial sewing machine. In addition, based on the rotational speed of the drive shaft of the head 1, which is detected with the aid of a digital rotational speed indicator, and depending on the distance of drive shaft 8 from the longitudinal axis of needle 4 which distance is readable from rail 25 and supplied as an input to control 32, the control device produces control impulses for the step motor 18, the frequency of which is determined such that the material to be sewn is transported by the second transport device 7 into the operating area of the sewing needle 4 with a speed that is equal to the transport speed exerted by the transporter 2. Because the step motor 18 continuously drives the drive shaft 8 when the drive shaft of the head 1 runs, there are no synchronization problems when the transport is transferred from one transport device to the other transport device.

As shown particularly in FIG. 1, in the exemplary embodiment, an edge guide 35 is provided for the material to be sewn, against which not only a straight edge of the material to be sewn is guided, but also the edge of an inside curve, for which reason the edge guide 35, which is formed by a plate, has a guiding edge curved to correspond with an outside curve. Due to this edge guide 35 and the second transport device 7, straight seams, inside curves and outside curves can be sewn with this sewing machine without the operator having to guide the material to be sewn during the sewing process. All seams or seam sections can therefore be produced at the full sewing speed.

All characteristics mentioned in the above specification, as well as those which can be obtained only from the drawings, are components of the invention as additional embodiments, even when they are not especially emphasized and particularly not mentioned in the claims.

What I claim is:

1. A sewing machine, comprising:

a sewing needle:

first means for transporting material to be sewn, the transporting means having a transporter acting on one side of the material to be sewn and a presser foot which can be placed on the other side of the material to be sewn in the effective area of the transporter;

second means for transporting the material to be sewn which can be switched from an ineffective condition into an effective condition and vice versa;

said second transporting means including a transport element rotatable about an axis parallel to and at a distance from the longitudinal axis of the sewing needle which in the effective condition takes hold of the material to be sewn at a distance from and adjacent the first transporting means by being placed on the material on the same side as the pressure foot and rotates about the rotational axis of the transport element; and a control device, which, during the sewing of a circular curved seam to be produced with the aid of the second transport device, holds the first transport device in an ineffective condition and holds the second transport device in an effective condition, and for seams that may be produced in a different shape, holds the first transport device in an effective condition and holds the second transport device in an ineffective condition.

2. The sewing machine according to claim 1, wherein the control device includes a sensor which scans an edge of the material to be sewn, parallel to the seam to be produced, at a point lying in front of the operating point of the sewing needle, and which, at the recognition of the beginning and the end of a seam to be sewn with the aid of the second transporting means, produces control signals.

3. The sewing machine according to claim 2, wherein the sensor is formed as a light barrier.

4. The sewing machine according to claim 2, wherein the control device contains a delay device which effects delays in the switching of the transport devices relative to the occurrence of the control signals.

5. The sewing machine according to claim 1, wherein the second transport means has its own drive motor, the rotational movement of which is controlled by the control device in dependence on the operating speed of the sewing machine.

6. The sewing machine according to claim 5, wherein the control device holds the rotational speed of the drive motor at a value at which the transport speed in the effective area of the sewing needle is equal to the transport speed of the first transporting means.

7. The sewing machine according to claim 6, wherein the transport element of the second transporting means is arranged at the end of a longitudinally shiftable drive shaft lying parallel to the longitudinal axis of the sewing needle.

8. The sewing machine according to claim 7, wherein the drive shaft is coupled with a shifting device that is controlled by the control device and is formed by a pneumatic operating cylinder.

9. The sewing machine according to claim 7, wherein the transport element is formed as a stamp having a support and carrier disc that is rigidly connected with the drive shaft and with a pressure disc that is connected therewith so as to yield elastically in the axial direction and yet so as to rotate therewith.

10. The sewing machine according to claim 1, wherein the presser foot which is shiftable in the longitudinal direction of the sewing needle is coupled with a shifting device which is controlled by the control device and is formed as a pneumatic operating cylinder.

11. The sewing machine according to claim 1, wherein the second transporting means has a mounting device which permits its adjustment laterally to the transport direction of the first transporting means.

12. The sewing machine according to claim 11, wherein the mounting device is provided with a display device which indicates the position of the second transporting means relative to the sewing needle, thus giving the radius of the path formed by the seam during transport of the material to be sewn by means of the second transport device.

13. The sewing machine according to claim 11, further comprising an adjusting drive which permits the adjustment of the second transporting means relative to the mounting device.

14. The sewing machine according to claim 1, further comprising an edge guide for the section of the edge of the material to be sewn that is approaching the sewing needle.

15. The sewing machine according to claim 14, wherein the edge guide has a curvature which is opposite the curvature of the seam sewn with the aid of the second transport device.

16. A sewing machine, comprising:

a sewing needle;

first means for transporting material to be sewn having a transporter acting on one side of the material and a presser foot on the other side of the material;

second means for transporting the material to be sewn having a transport element rotatable about an axis parallel to and at a distance from the longitudinal axis of the sewing needle;

control means for switching the operation of the sewing machine from a first mode wherein the first transporting means is effective and the second transporting means is ineffective to a second mode wherein the first transporting means is ineffective and the second transporting means is effective wherein, when said second transporting means is effective, said second transporting means takes hold of the material to be sewn at a distance from and adjacent the first transporting means by being placed on the material on the same side as the pressure foot and rotates about the rotational axis of said second transporting means.

17. The sewing machine according to claim 16, wherein the second transporting means rotates the material to be sewn for sewing curved seams.

18. The sewing machine according to claim 16, further comprising sensing means for scanning the material to be sewn and sending a signal to the control means.

* * * * *